US008018429B2

(12) United States Patent
Choi et al.

(10) Patent No.: US 8,018,429 B2
(45) Date of Patent: Sep. 13, 2011

(54) SURFACE PLASMON DISPLAY DEVICE AND METHOD THEREOF

(75) Inventors: Jae-young Choi, Yongin-si (KR); Jai-yong Han, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 956 days.

(21) Appl. No.: 11/948,217

(22) Filed: Nov. 30, 2007

(65) Prior Publication Data

US 2009/0027329 A1 Jan. 29, 2009

(30) Foreign Application Priority Data

Jul. 25, 2007 (KR) ..... 10-2007-0074651

(51) Int. Cl.
*G09G 3/34* (2006.01)

(52) U.S. Cl. ..... 345/107; 359/296

(58) Field of Classification Search ..... 345/107, 345/204; 359/290, 296
See application file for complete search history.

(56) References Cited

U.S. PATENT DOCUMENTS

| | | | | |
|---|---|---|---|---|
| 3,682,528 | A * | 8/1972 | Apfel et al. | 359/360 |
| 6,017,584 | A | 1/2000 | Albert et al. | |
| 7,295,364 | B2 * | 11/2007 | Yamamoto | 359/296 |
| 2007/0279378 | A1 * | 12/2007 | Takeuchi et al. | 345/107 |

OTHER PUBLICATIONS

"Substrate effects on surface-plasmon spectra in metal-island films"; Authors: P. Royer, et al.; Physical Review B, vol. 35, No. 8; Mar. 15, 1987 (pp. 3753-3762).

* cited by examiner

*Primary Examiner* — Stephen Sherman
(74) *Attorney, Agent, or Firm* — Cantor Colburn LLP

(57) ABSTRACT

A surface plasmon display device includes metal particles having a constant size within all of the pixel regions between a first electrode and a second electrode and a dielectric layer corresponding to each of the pixel regions formed on an inner surface of a first substrate, wherein the dielectric layer in each of the pixel regions has physical properties for causing the surface plasmon resonance corresponding to a wavelength designated to the corresponding pixel region.

20 Claims, 4 Drawing Sheets

SURFACE PLASMON DISPLAY DEVICE AND METHOD THEREOF

This application claims priority to Korean Patent Application No. 10-2007-0074651, filed on Jul. 25, 2007, and all the benefits accruing therefrom under 35 U.S.C. §119, the contents of which in its entirety are herein incorporated by reference.

BACKGROUND OF THE INVENTION

1. Field of the Invention

The present invention relates to a surface plasmon display device and a method thereof, and more particularly, to a surface plasmon display device having a simple structure and capable of representing colors, and a method of representing colors in the display device.

2. Description of the Related Art

Reflective displays can realize flexible displays with low costs, and have low power consumption. Therefore, a reflective display is used as a display device in low power mobile displays. The reflective displays can be electrophoretic displays ("EPDs"), liquid crystal displays ("LCDs"), electrowetting displays ("EWDs"), and electrochromic displays ("ECDs"). Among the above, the most developed reflective display is the EPD, which uses the movements of particles. However, the most important technical issue of the reflective display is to represent colors.

In order to realize the representation of colors, micro capsules including R (red), G (green), and B (blue) particles are prepared, and then, the micro-capsules respectively including the R, G, and B particles are arranged on a substrate, such as by a method suggested by E-Ink Corp.

Alternatively, a method of coating a color filter on a surface of the microcapsule has been suggested, however, since the color filter absorbs about ⅔ of incident light, the brightness of the reflective display quality is degraded. Otherwise, in order to present the colors, the R, G, and B particles are selectively input into micro-cups or cells that are designated as R, G, and B colors, such as by a method suggested by Sipix Corp. or Bridgestone Corp.

BRIEF SUMMARY OF THE INVENTION

It has been determined herein according to the present invention that the process of inputting color particles respectively into micro-cups or cells as is done in conventional display devices is complex and causes an increase in manufacturing costs.

The present invention provides a surface plasmon display device that can realize colors without using barriers or cells.

The present invention also provides a surface plasmon display device having a simple structure, which can be fabricated easily with low fabrication costs.

The present invention also provides a method of providing a display that can realize colors without using barriers or cells.

According to exemplary embodiments of the present invention, a surface plasmon display device includes a plurality of pixel regions, metal particles formed in the pixel regions, a dielectric layer which generates a surface plasmon resonance by contacting with the metal electrophoretic particles, and an electrode structure which induces electrophoresis of the metal particles in the pixel regions, wherein a wavelength of the surface plasmon resonance in each of the pixel regions is determined by at least one of a thickness of the dielectric layer and a dielectric constant of the dielectric layer, and the metal particles in the pixel regions are formed of a same material having a constant size.

Each of the pixel regions may further include white reflective electrophoretic particles. The pixel regions may be spatially connected to each other.

According to other exemplary embodiments of the present invention, a surface plasmon display device includes a first substrate and a second substrate which form a space in which electrophoretic particles including metal particles are included, an electrode structure including a first electrode and a second electrode respectively formed on the first substrate and the second substrate, a plurality of pixel regions that can be electrically addressed by the electrode structure, and a dielectric layer formed on an inner surface of the first substrate to correspond to each of the pixel regions to generate a surface plasmon resonance with the metal particles, wherein the dielectric layer in each of the pixel regions has physical properties which cause the surface plasmon resonance corresponding to a wavelength designated to a corresponding pixel region.

The electrophoretic particles may further include charged particles reflecting or absorbing the visible rays, and may further include electrophoretic particles reflecting white rays or black electrophoretic particles.

The electrode structure may be an X-Y matrix type arrangement structure or an active matrix type arrangement structure including active devices such as transistors.

According to still other exemplary embodiments of the present invention, a method of representing colors in a display device is provided. The display device includes first and second substrates which form a space therebetween, a plurality of electrophoretic particles formed in the space, an electrode structure including a first electrode and a second electrode respectively formed on the first substrate and the second substrate, and a plurality of pixel regions electrically addressed by the electrode structure. The method includes including a plurality of metal particles amongst the electrophoretic particles, and forming a dielectric layer within each pixel region on the first substrate to generate a surface plasmon resonance with the metal particles, wherein at least one of a thickness or a dielectric constant of the dielectric layer within each pixel region is selectively chosen to cause the surface plasmon resonance to correspond to a particular wavelength designated to each corresponding pixel region.

Including a plurality of metal particles may include including a plurality of metal particles having a constant size and formed of a same material.

Forming a dielectric layer within at least one of the pixel regions may include forming at least two dielectric layers having a dielectric constant different from that of each other.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
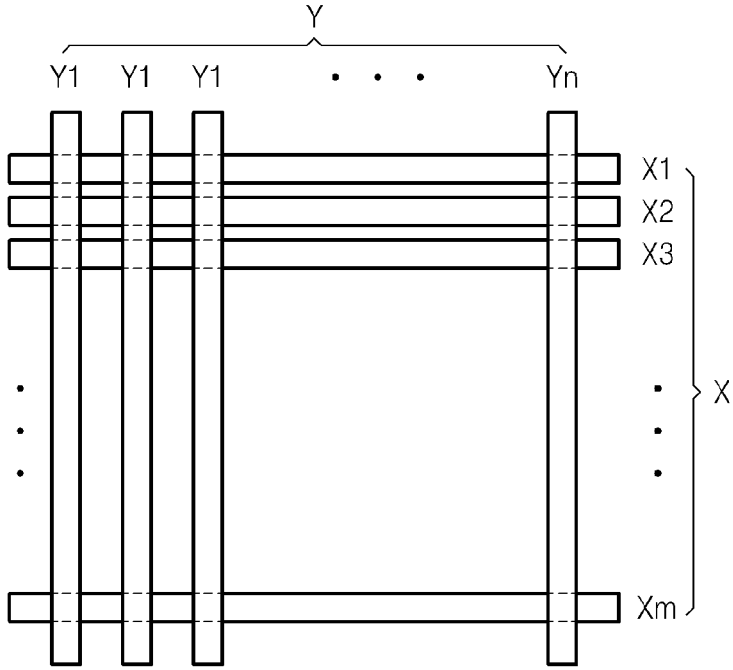
FIGS. 1 and 2 are diagrams respectively showing exemplary electrode arrangement structures of a passive matrix type and an active matrix type that can be adopted by an exemplary surface plasmon display device, according to an exemplary embodiment of the present invention.

The invention will now be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

Hereinafter, embodiments of a surface plasmon display device according to the present invention will be described with reference to the accompanying drawings.

Briefly, the present invention is based on an electrophoresis of particles and a surface plasmon resonance between a metal, such as metal particles, and a dielectric layer. According to exemplary embodiments of the present invention, a movement of particles corresponds to a switching process of a particular pixel, and the surface plasmon resonance between the moved particles and the dielectric layer corresponds to a process of representing a light of a designated color.

A light emission wavelength of the particular pixel is controlled by conditions of a surface plasmon, that is, a dielectric constant of the dielectric layer and sizes of metal electrophoretic particles (hereinafter, referred to as metal particles). In the exemplary embodiments of the present invention, metal particles having constant sizes are used in all of the pixels, and thus, the light emission wavelength of each of the pixels is determined by selecting a thickness of the dielectric layer. According to an exemplary embodiment of the present invention, a dielectric layer is formed on the entire pixels, or substantially the entire pixels, of an identical material, and according to another exemplary embodiment of the present invention, some of the pixel regions can have the dielectric layer formed of a different material from that of the dielectric layer in other pixel regions. In exemplary embodiments of the present invention, the sizes of the metal particles are formed to be identical so as to exclude the necessity for barrier ribs that define the pixels in a space where the metal particles exist. Instead of various sized metal particles, physical conditions or material characteristics of the dielectric layer can be differentiated in order to generate a surface plasmon emission within a designated wavelength in each of the pixels.

The surface plasmon absorbs the light selectively, and reflects the light of a certain wavelength, see Physical Review B, Vol 35, No. 8, Page 3753, herein incorporated by reference.

The wavelength of the light that is absorbed by the surface plasmon is determined by a shape of the metal particle, a size of the metal particle, a shape of the dielectric layer, a dielectric constant, and a contacting status between the metal particle and the dielectric layer. This is based on a fact that a light of a certain wavelength is absorbed in a visible ray region when the metal particles contact the dielectric layer.

The metal particle can be formed of a material that can induce the surface plasmon phenomenon when the metal particle contacts the dielectric layer, for example, the material of the metal particle may include silver Ag or gold Au. The size of the metal particle ranges from about 1 to about 1000 nm, and the size of the metal particle that is actually used must be smaller than a size of a unit pixel in the display device. Since the metal particle moves by electrophoresis, positive charges and negative charges are formed on a surface of the metal particle.

In exemplary embodiments of the present invention, the dielectric layer must be transparent since the surface plasmon display device of the present invention is a reflective display device. $TiO_2$, $SiO_2$, and lead fluoride are transparent in the visible ray area, and thus, the dielectric layer of the present invention may include such materials. The thickness of the dielectric layer can range from about 1 to about 1000 nm. According to exemplary embodiments of the present invention, since the wavelength absorbed by the surface plasmon is changed according to the thickness of the dielectric layer, the wavelength of the light to be absorbed by the surface plasmon may be selected by adjusting the thickness of the dielectric layer. Therefore, the dielectric constant of the dielectric layer may be changed or the thickness of the dielectric layer may be adjusted in order to control the wavelength of the light that is absorbed by the surface plasmon, and, if necessary, the change of the dielectric constant and the adjustment of the thickness may be performed simultaneously. The dielectric layer may be a single layer or a multi-layered structure.

The size of a unit pixel must be appropriate to realize the display, and, in exemplary embodiments of the present invention, a shape of an electrode structure determines the size of the unit pixel. The size of the unit pixel may range from about 1 to about 1000 μm in width and length.

According to the present invention, the metal particles having a constant size are used on the entire area, or at least substantially an entire area, of the display, and thus, there is no need to divide the space where the metal particles exist into pixel regions. In addition, a spacer, such as a spacer used in general liquid crystal displays ("LCD") devices, can be used in order to maintain a distance between a front substrate and a rear substrate, where the particles are formed between the front and rear substrates. A height of the spacer can range from about 1 to about 1000 μm.

The substrate used in the display device according to the present invention is not limited to a specific material, for example, the substrate may be a glass substrate or a plastic substrate. The plastic substrate, for example, may include polyethylene terephthalate ("PET"), polyethylene naphthalate ("PEN"), or polyethersulfone ("PES"). In addition, a thickness of the substrate may range from about 10 to about 1000 μm.

Figure 2:
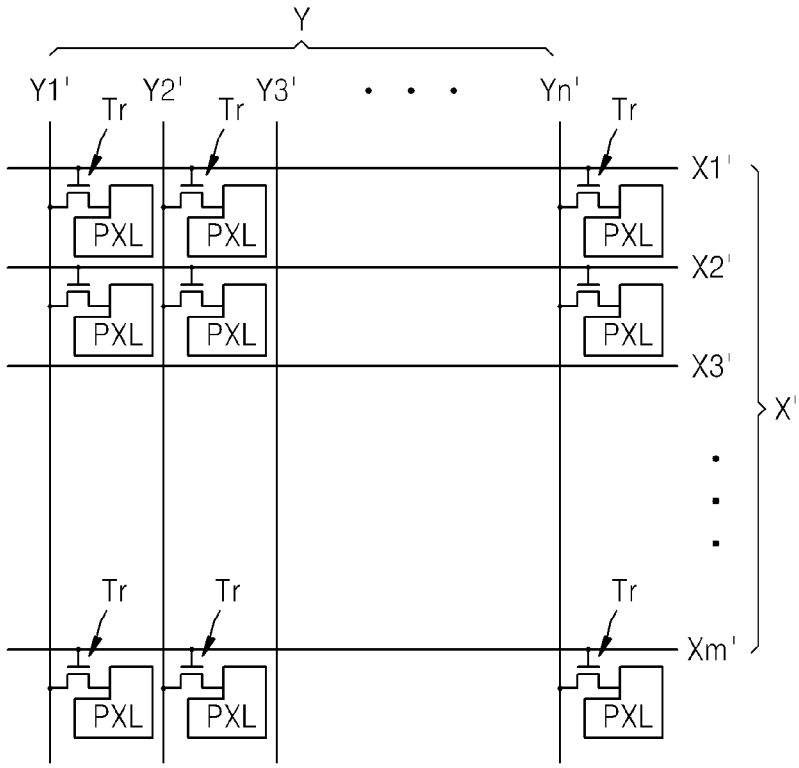

FIGS. 1 and 2 are diagrams showing exemplary electrode arrangement structures of a passive matrix type and an active matrix type applied in an exemplary surface plasmon display device, according to an exemplary embodiment of the present invention.

FIG. 1 shows the exemplary electrode arrangement in a passive matrix type, and FIG. 2 shows the exemplary electrode arrangement in an active matrix type.

The electrode arrangement structure of a passive matrix type includes a first electrode arrangement X having a plurality of electrodes (X1, X2, X3, ~, Xm) in a first direction and a second electrode arrangement Y having a plurality of electrodes (Y1, Y2, Y3, ~, Yn) in a second direction that crosses the first direction at a right angle. In an exemplary embodiment of the electrode arrangement structure of the passive matrix type, the unit pixels may be defined relative to portions where the electrodes of the first electrode arrangement X and the electrodes of the second electrode arrangement Y cross each other.

The electrode arrangement structure of the active matrix type, as shown in FIG. 2, includes a first electrode arrangement X' and a second electrode arrangement Y' as in the electrode arrangement structure of the passive matrix type. In the active matrix type, each unit pixel includes a transistor Tr disposed on a portion where each of the electrodes (X1', X2', X3', ~, Xm') of the first electrode arrangement X' and each of the electrodes (Y1', Y2', Y3', ~, Yn') of the second electrode arrangement Y' cross each other, and a pixel electrode PXL connected to the transistor Tr. A region representing a color is determined by the pixel electrode PXL that is connected to the transistor Tr, and a common electrode (not shown) corresponding to all of the pixel electrodes PXL is disposed on a portion in a predetermined gap. The structure of the electrode arrangement structure of the active matrix type shown in FIG. 2 may be substantially the same as the electrode arrangement structure of general LCDs.

While exemplary passive and active matrix types of electrode arrangements have been described with respect to FIGS. 1 and 2, the surface plasmon display device of the present invention is not limited to such electrode arrangement structures.

Figure 3A:
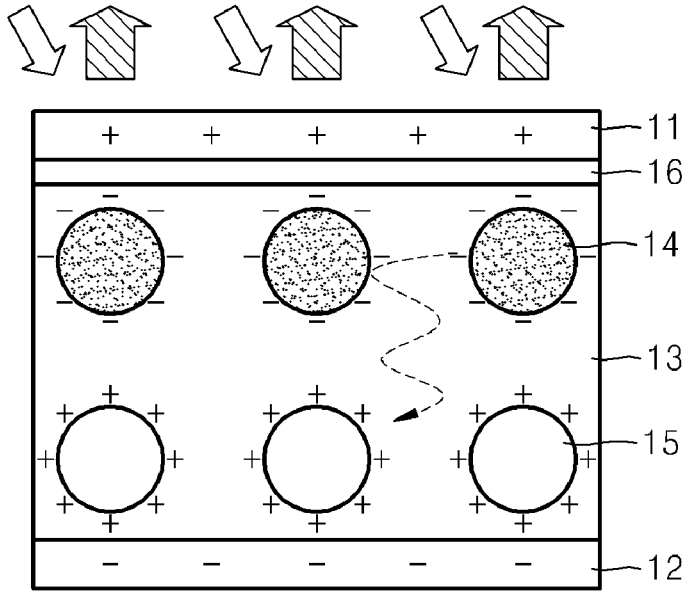
FIGS. 3A and 3B are diagrams illustrating a principle of emitting lights of different colors according to movements of exemplary electrophoretic particles and a surface plasmon resonance, according to an exemplary embodiment of the present invention.
Figure 3B:
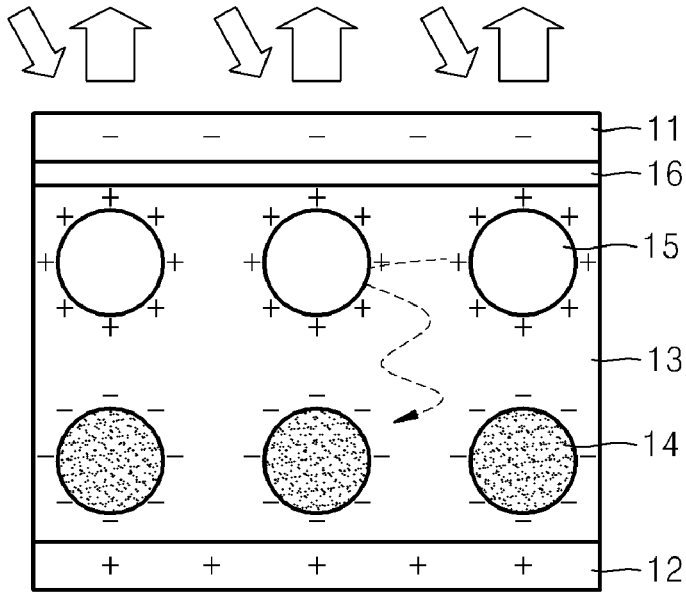

FIGS. 3A and 3B are diagrams showing exemplary pixels for illustrating a principle of representing two colors in the exemplary surface plasmon display device, according to an exemplary embodiment of the present invention.

Referring to FIGS. 3A and 3B, a cell space 13 is formed between a first electrode 11 and a second electrode 12, which face each other, and metal particles 14 formed of a material, such as Au, for causing the surface plasmon phenomenon and reflective charged particles 15 (hereinafter, referred to as reflective particles) formed of $TiO_2$ are dispersed in the cell space 13. A dielectric layer 16, causing the surface plasmon phenomenon with the metal particles 14, is formed on an inner surface of the first electrode 11 onto which external light is incident. The inner surface of the first electrode 11 faces the inner surface of the second electrode 12, and therefore in one exemplary embodiment, the dielectric layer 16 is formed between the first and second electrodes 11 and 12. In one exemplary embodiment, the metal particles 14 are negatively charged, and the reflective particles 15 are positively charged.

As shown in FIG. 3A, when voltages are applied to the first electrode 11 and the second electrode 12 to apply a positive potential to the first electrode 11 and a negative potential to the second electrode 12, respectively, the metal particles 14 having the negative charges contact the inner surface of the dielectric layer 16, and the reflective particles 15 having the positive particles move toward the second electrode 12. In a state where the metal particles 14 and the reflective particles 15 are moved by the voltages that are applied to the first and second electrodes 11 and 12, the surface plasmon resonance occurs between the dielectric layer 16 and the metal particles 14 contacting the dielectric layer 16, and accordingly, light having the wavelength of a certain band exits outwardly through the first electrode 11. Here, the dielectric constant and the thickness of the dielectric layer 16, and the size of the metal particles 14 are adjusted to emit blue color, and thus, the blue light can be emitted through the first electrode 11.

On the other hand, when the polarities of the voltages that are applied to the first and second electrodes 11 and 12 are changed, the metal particles 14 move toward the second electrode 12 and the reflective particles 15 move toward the first electrode 11. Therefore, the external light may be reflected by the reflective particles 15 and output through the first electrode 11. If the reflective particles 15 are white, the reflected light becomes the white light. Alternatively, if the reflective particles 15 are black, the external light is not reflected by the reflective particles 15, and is instead absorbed, and thus, the display becomes black when the display is seen from the outside.

The emission of two colors using the two kinds of particles, metal particles and reflective particles, is described as above. The present invention uses such principle to provide the exemplary surface plasmon display device that does not include barrier ribs, which are generally used in conventional color display structures and are considered to be essential in the display field.

Figure 4:
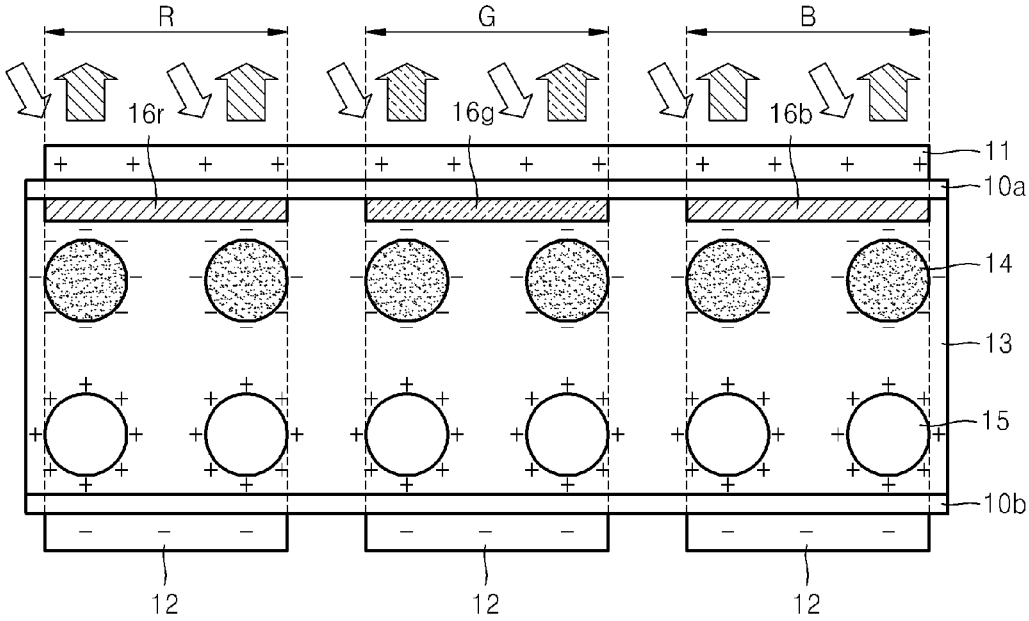
FIG. 4 is a diagram showing exemplary R, G, and B unit pixels for displaying color images in the exemplary surface plasmon display device, according to an exemplary embodiment of the present invention.

FIG. 4 is a diagram showing exemplary red R, green G, and blue B unit pixels for displaying color images in the exemplary surface plasmon display device, according to an exemplary embodiment of the present invention.

Referring to FIG. 4, each of the R, G, and B unit pixels includes a second electrode 12, such that the second electrodes 12 are independent from each other. The first electrode 11, facing the second electrode 12, is a common electrode shared by all of the unit pixels. The first and second electrodes 11 and 12 may be formed on outer surfaces of a first substrate 10*a* and a second substrate 10*b*, and a cell space 13, including the metal particles 14 and the reflective particles 15, is disposed between the first and second substrates 10*a* and 10*b*. The metal particles 14 generate the surface plasmon resonance at a certain wavelength band with dielectric layers 16*r*, 16*g*, or 16*b*, which are formed on the inner surface of the first substrate 10*a*, of each of the R, G, and B unit pixels. The metal particles 14 are formed of an identical material, for example, Au, having a constant size, throughout all of the unit pixels. In addition, the reflective particles 15 are also formed of an identical material having a constant size, for example, $TiO_2$. In the illustrated embodiment, the first and second electrodes 11 and 12 are formed on outer surfaces of the first and second substrates 10*a* and 10*b*, respectively, however, the present invention is not limited thereto, and thus, the first and second electrodes 11 and 12 may alternatively be formed on inner surfaces of the first and second substrates 10*a* and 10*b* in other exemplary embodiments. Therefore, the locations of the first and second electrodes 11 and 12 do not limit the technical scope of the present invention.

According to exemplary embodiments of the present invention, the emission of light in the certain wavelength band from the regions defined as R, G, and B pixels is controlled by the thickness of the dielectric layer 16*r*, 16*g*, 16*b*, and/or the dielectric constant of the dielectric layer 16*r*, 16*g*, 16*b*, respectively. Physical Review B, Vol 35, No. 8, Page 3753, herein incorporated by reference, can be referred to in regard to the controlling of wavelength using the thickness of the dielectric layer and the dielectric constant.

According to exemplary embodiments of the present invention, in order to control the emission of the light in the certain wavelength band from the R, G, and B pixels, for each dielectric layer 16*r*, 16*g*, and 16*b*, two or more dielectric layers that are different from each other can be deposited in a direction perpendicular to the substrate 10*a*. That is, for each pixel, two or more dielectric layers that are different from each other can be deposited and layered on the substrate 10*a*.

According to exemplary embodiments of the present invention, in order to control the emission of the light in the certain wavelength band from the R, G, and B pixels, different types of dielectric materials used in the unit pixels R, G, and B can be mixed in a direction in parallel with the substrate 10*a*. That is, dielectric layers that are different from each other may be formed on the substrate 10*a* within adjacent pixels and within a same pixel.

Therefore, the present invention does not require barrier ribs for defining the R, G, and B unit pixel regions. Thus, complex processes of forming the barrier ribs and of injecting certain metal particles into unit pixel regions defined by such barrier ribs are not required.

Exemplary materials forming the dielectric layers 16*r*, 16*g*, and 16*b* in the pixels R, G, and B and exemplary thicknesses of the dielectric layers 16*r*, 16*g*, and 16*b*, and the sub-layers within the dielectric layers 16*r*, 16*g*, and 16*b*, and types and sizes of the metal particles 14 according to exemplary embodiments of the present invention may be as follows.

| | | R region | G region | B region |
|---|---|---|---|---|
| Dielectric layer | Material | $SiO_2$/PbF | $SiO_2$/PbF + $SiO_2$/$TiO_2$ | $SiO_2$/$TiO_2$ |
| | Thickness | 1 nm/ 12 nm | 1 nm/12 nm + 1 nm/1 nm | 1 nm/4 nm |
| Metal particle | Material | Ag | Ag | Ag |
| | Size (diameter) | 30 nm | 30 nm | 30 nm |

It should be understood that while particular examples of materials and dimensions are provided for exemplary purposes, such examples are not presented to limit the scope of the invention. That is, alternate materials and dimensions are also within the scope of these embodiments.

Figure 5A:
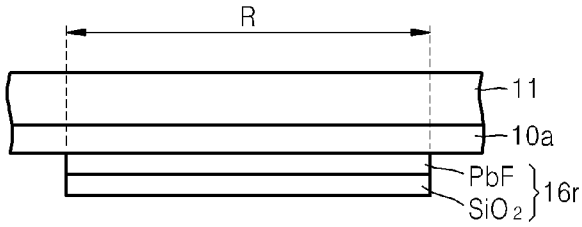
FIGS. 5A, 5B, and 5C are schematic cross-sectional views showing modified examples of an exemplary dielectric layer in a pixel region of the exemplary surface plasmon display device, according to an exemplary embodiment of the present invention.
Figure 5B:
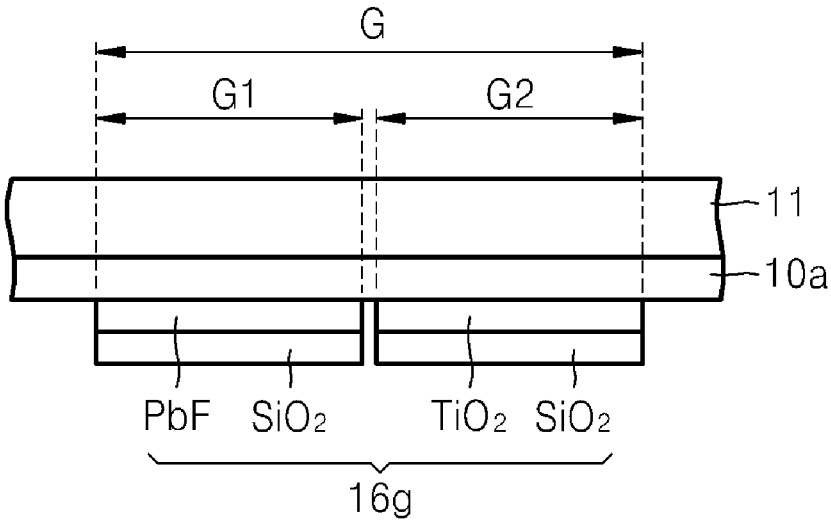
Figure 5C:
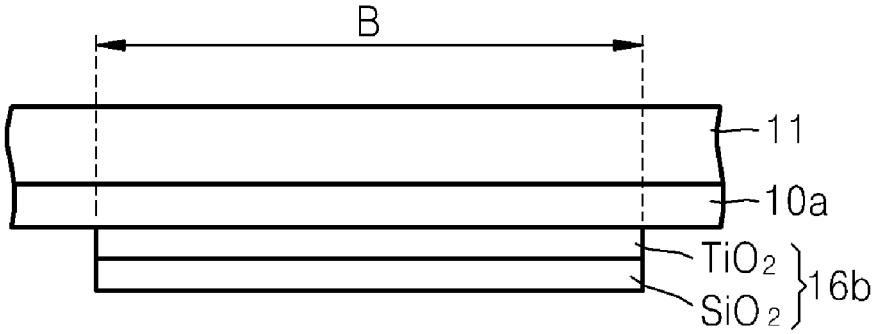

As shown in FIG. 5A, the dielectric layer 16*r* of the R emission region has a stacked structure of $SiO_2$/PbF. Here, the material close to the first substrate 10*a* is PbF and the material contacting Ag of the metal particles 14, when the metal particles 14 and the first electrode 11 are oppositely charged, is $SiO_2$. As shown in FIG. 5B, the dielectric layer 16*g* of the G emission region has a stacked structure of $SiO_2$/PbF+$SiO_2$/$TiO_2$. This means that one G pixel is divided into two portions G1 and G2 and the stacked structure of $SiO_2$/PbF and the stacked structure of $SiO_2$/$TiO_2$ are respectively formed on the portions G1 and G2. In portion G1, the material closer to the first substrate 10*a* is PbF, while in portion G2, the material closer to the first substrate 10*a* is $TiO_2$. In both portions G1 and G2, the material contacting Ag of the metal particles 14, when the metal particles 14 and the first electrode 11 are oppositely charged, is $SiO_2$. For example, when it is assumed that an entire area of the G emission region is about 100 μm×about 100 μm, the stacked structure of $SiO_2$/PbF and the stacked structure of $SiO_2$/$TiO_2$ are respectively formed on the portions G1 and G2, each having an area of about 50 μm×about 100 μm. A rate of dividing the region can be adjusted according to the required wavelength. In addition, the region can be divided into two or more portions according to the required wavelength and color quality. As shown in FIG. 5C, the dielectric layer 16*b* of the B emission region has a stacked structure of $TiO_2$/$SiO_2$. Here, the material close to the first substrate 10*a* is $TiO_2$ and the material contacting Ag of the metal particles 14, when the metal particles 14 and the first electrode 11 are oppositely charged, is $SiO_2$.

While a particular exemplary arrangement has been described, alternate arrangements are within the scope of these embodiments. For example, the dielectric layers 16*r*, 16*g*, or 16*b* shown in FIGS. 5A, 5B, and 5C can be applied to all of the pixel regions, such as the dielectric layer 16*b* shown in FIG. 5B can be applied to the R emission region and the B emission region, and the dielectric layer 16*r* and 16*b* shown in FIG. 5A or 5C can be applied to the G emission region. The material forming the dielectric layers 16*r*, 16*g*, or 16*b* and the stacked structure of each of the pixel regions should be selected and adjusted corresponding to the required wavelength, and the selection and the adjustment can be based on the above exemplary embodiments of the present invention.

According to exemplary embodiments of the present invention, barrier ribs for defining pixels are not required. However, a spacer for maintaining a distance between the first substrate and the second substrate is required. Various types of spacers such as a bar type spacer and a ball type spacer, such as that used in a general LCD, may be used. The usage of the spacer and the type of the spacer do not limit the technical scope of the present invention.

According to exemplary embodiments of the present invention, the barrier ribs for defining the pixels are not required, and in particular, identical metal particles having a constant size can be used throughout all of the pixels. Therefore, fabrication of the surface plasmon display device is simplified and may be accomplished with low fabrication costs.

In addition, according to exemplary embodiments of the present invention, the light of a desired color can be selectively emitted using the movements of particles and the surface plasmon resonance of the moved particles. Therefore, the present invention can be applied to a color display device, in particular, a color display device using the above-described principle.

While the present invention has been particularly shown and described with reference to exemplary embodiments thereof, it will be understood by one of ordinary skill in the art that various changes in form and details may be made therein without departing from the spirit and scope of the present invention as defined by the following claims.

What is claimed is:

1. A surface plasmon display device comprising:

a first substrate and a second substrate which form a space in which electrophoretic particles including metal particles are included;

an electrode structure including a first electrode and a second electrode respectively formed on the first substrate and the second substrate;

a plurality of pixel regions that can be electrically addressed by the electrode structure; and a dielectric layer formed on an inner surface of the first substrate to correspond to each of the pixel regions to generate a surface plasmon resonance with the metal particles, wherein the dielectric layer in each of the pixel regions has physical properties which cause the surface plasmon resonance corresponding to a wavelength designated to a corresponding pixel region of the plurality of pixel regions, the second electrode includes a plurality of sub-electrodes corresponding to each of the pixel regions and the dielectric layer includes a plurality of sub-dielectric layers corresponding to each of the sub-electrodes, wherein the sub-electrodes are independent from each other and the sub-dielectric layers are independent from each other.

2. The surface plasmon display device of claim 1, wherein the electrophoretic particles further include black reflective particles or white reflective particles included in the space.

3. The surface plasmon display device of claim 1, wherein the physical properties of the dielectric layer include the thickness of the dielectric layer or a dielectric constant of the dielectric layer.

4. The surface plasmon display device of claim 3, wherein a spacer is formed between the first substrate and the second substrate in order to maintain a distance between the first and second substrates.

5. The surface plasmon display device of claim 3, wherein the dielectric layer in each of the pixel regions includes two or more dielectric layers having a dielectric constant different from that of each other.

6. The surface plasmon display device of claim 5, wherein at least one of the pixel regions includes a plurality of divided portions, and two or more dielectric layers having a dielectric constant different from that of each other are formed in each of the divided portions.

7. The surface plasmon display device of claim 1, wherein a spacer is formed between the first substrate and the second substrate in order to maintain a distance between the first and second substrates.

8. The surface plasmon display device of claim 1, wherein a wavelength of emitted light from each of the pixel regions is determined by at least one of a thickness of the dielectric layer and a dielectric constant of the dielectric layer.

9. The surface plasmon display device of claim 1, wherein the dielectric layer in each of the pixel regions includes two or more dielectric layers having a dielectric constant different from that of each other.

10. The surface plasmon display device of claim 9, wherein at least one of the pixel regions includes a plurality of divided portions, and two or more dielectric layers having a dielectric constant different from that of each other are formed in each of the divided portions.

11. The surface plasmon display device of claim 1, wherein the metal particles in each of the pixel regions have a constant size and are formed of a same material.

12. A surface plasmon display device comprising:

a plurality of pixel regions;

metal particles having a constant size and formed of a same material formed in each of the pixel regions;

a dielectric layer which generates a surface plasmon resonance by contacting with the metal electrophoretic particles; and an electrode structure which induces electrophoresis of the metal particles in the pixel regions, wherein a wavelength of the surface plasmon resonance in each pixel region is determined by at least one of a thickness of the dielectric layer and a dielectric constant of the dielectric layer, the electrode structure includes a first electrode and a second electrode which face each other, the second electrode includes a plurality of sub-electrodes orresponding to each of the pixel regions and the dielectric layer includes a plurality of sub-dielectric layers corresponding to each of the sub-electrodes, wherein the sub-electrodes are independent from each other and the sub-dielectric layers are independent from each other.

13. The surface plasmon display device of claim 12, wherein each of the pixel regions further includes white reflective electrophoretic particles.

14. The surface plasmon display device of claim 12, wherein the pixel regions are spatially connected to each other.

15. The surface plasmon display device of claim 12, wherein the dielectric layer in each of the pixel regions includes two or more dielectric layers having a dielectric constant different from that of each other.

16. The surface plasmon display device of claim 15, wherein at least one of the pixel regions includes a plurality of divided portions, and two or more dielectric layers having a dielectric constant different from that of each other are formed in each of the divided portions.

17. The surface plasmon display device of claim 12, wherein at least one of the pixel regions includes a plurality of divided portions, and. two or more dielectric layers having a dielectric constant different from that of each other are formed in each of the divided portions.

18. A method of manufacturing a display device, the display device including first and second substrates which form a space therebetween, a plurality of electrophoretic particles formed in the space, an electrode structure including a first electrode and a second electrode respectively formed on the first substrate and the second substrate, and a plurality of pixel regions electrically addressed by the electrode structure, the method comprising:

including a plurality of metal particles amongst the electrophoretic particles; and, forming a dielectric layer within each pixel region on the first substrate to generate a surface plasmon resonance with the metal particles;

wherein at least one of a thickness or a dielectric constant of the dielectric layer within each pixel region is selectively chosen to cause the surface plasmon resonance to correspond to a particular wavelength designated to each corresponding pixel region of the plurality of pixel regions, the second electrode includes a plurality of sub-electrodes corresponding to each of the pixel regions and the dielectric layer includes a plurality of sub-dielectric layers corresponding to each of the sub-electrodes, wherein the sub-electrodes are independent from each other and the sub-dielectric layers are independent from each other.

19. The method of claim 18, wherein including a plurality of metal particles includes including a plurality of metal particles having a constant size and formed of a same material.

20. The method of claim 18, wherein forming a dielectric layer within at least one of the pixel regions includes forming at least two dielectric layers having a dielectric constant different from that of each other.

* * * * *